United States Patent [19]

Clarkson et al.

[11] Patent Number: 4,593,423

[45] Date of Patent: Jun. 10, 1986

[54] LASTING HEEL SEAT AND SIDE PORTIONS OF A SHOE

[75] Inventors: Andrew P. Clarkson, Quorn; James R. Flanders, Blaby; Frank C. Price, Leicester, all of England

[73] Assignee: USM Corporation, Farmington, Conn.

[21] Appl. No.: 436,290

[22] Filed: Oct. 25, 1982

[30] Foreign Application Priority Data

Oct. 29, 1981 [GB] United Kingdom ..... 8132558

[51] Int. Cl.[4] ..... A43D 21/00

[52] U.S. Cl. ..... 12/145; 12/12

[58] Field of Search ..... 12/12.5, 12.3, 14.4, 12/54.3, 12, 145

[56] References Cited

U.S. PATENT DOCUMENTS

| | | | |
|---|---|---|---|
| Re. 28,825 | 5/1976 | Kamborian | 12/145 |
| 3,934,294 | 1/1976 | Vornberger | 12/145 |
| 4,120,063 | 10/1978 | Vornberger et al. | 12/12 |
| 4,296,513 | 10/1981 | Halford et al. | 12/12 |

*Primary Examiner*—Werner H. Schroeder
*Assistant Examiner*—Steven N. Meyers
*Attorney, Agent, or Firm*—Spencer T. Smith

[57] ABSTRACT

In a combined heel seat and side lasting machine, in which the heel seat lasting operation takes place during the dwell time necessary for the cement side lasting operation, the backpart of the shoe remains free of any clamping pressure at least in and adjacent the backseam region thereof, which pressure would have the effect of forcing excess material out of the heel seat region into the region to be lasted by the side lasting instrumentalities, while at the same time provision is made for locating the shoe, prior to the side lasting operation, in a predetermined relationship, both heightwise and lengthwise, with the heel seat lasting instrumentalities. To this end, the shoe is first located lengthwise by the heel band (16), whereafter, with the shoe clamped against a holddown (20), the heel band is retracted out of engagement with the backseam region of the shoe during the side lasting operation. If desired, to assist in controlling any excess material, breast line grippers (172) may be provided, in which case the heel band, in its retracted position, is caused to clamp on to the shoe to maintain the tension provided by the breast line grippers and enable them to be released prior to initiation of the side lasting operation.

19 Claims, 6 Drawing Figures

LASTING HEEL SEAT AND SIDE PORTIONS OF A SHOE

BACKGROUND OF THE INVENTION (1) Field of the Invention

This invention is concerned with lasting heel seat and side portions of a shoe. The term "shoe" where used herein is used generically as indicating articles of outer footwear generally, and as including such an article in the course of its manufacture.

(2) Prior Art

One known method of lasting heel seat and side portions of a shoe comprises locating a shoe in a position with the heel seat region thereof disposed in a pre-determined relationship with heel seat lasting instrumentalities both lengthwise and heightwise of the shoe, clamping the shoe in such position, causing side lasting instrumentalities to operate on the shoe thus clamped, and thereafter causing the heel seat lasting instrumentalities to operate thereon.

An important advantage of carrying out such a combined operation is one of time-saving, in that, especially when the side portions are cement lasted, the dwell time required for consolidating the lasted side portions can be utilized for the seat lasting operation. Of course, to this end it is essential for the shoe to be properly located in relation to the heel seat lasting instrumentalities prior to the side lasting operation being initiated. This is especially the case where the heel seat is to be tack-lasted, in order to ensure that the tack pattern (determined by the amount of inwiping movement of the heel seat wiper assembly) is properly located in relation to the heel seat region of the shoe being lasted.

In order to locate the shoe in a predetermined relationship with the heel seat lasting instrumentalities, therefore, conventionally the shoe is clamped by the heel band, which forms part of the heel seat lasting instrumentalities, prior to the side lasting operation being effected. However, the effect of forcing the shoe into the heel band, or alternatively forcing the heel band against the backpart of the shoe, is to cause any excess material in the heel seat to be urged toewardly, such excess material then gathering just forwardly of the heel band. Thus, this excess material is forced away from the operating area of the heel seat wiper assembly and into the area of the side lasting instrumentalities. In general, however, the side lasting instrumentalities cannot cope with excess material in the side of the shoe, and consequently, where there is significant excess material, creases are formed in the sides of the upper above the featherline thereof, so that such creases are visible in the finished shoe.

It is thus the object of the present invention to provide an improved method of lasting heel seat and side portions of a shoe, and also an improved machine for the lasting of heel seat and side portions of a shoe, wherein the formation of creases in the side portions of the shoe above the featherline is avoided.

SUMMARY OF THE INVENTION

The invention thus provides, in one of its several aspects, a method of lasting heel seat and side portions of a shoe comprising locating a shoe in a position with the heel seat region thereof disposed in a predetermined relationship with heel seat lasting instrumentalities both lengthwise and heightwise of the shoe, clamping the shoe in such position, causing side lasting instrumentalities to operate on the shoe thus clamped, and thereafter causing the heel seat lasting instrumentalities to operate thereon, characterized in that, during the lasting of the side portions of the upper, the backpart of the upper is free of any clamping pressure at least in and adjacent the backseam region thereof.

By freeing the backpart of the upper from any clamping pressure in and adjacent the backseam region thereof during the side lasting operation, any tendency to urge material toewardly out of the heel seat region is avoided, so that there is no gathering of excess material in the operative area of the side lasting instrumentalities.

Conveniently in carrying out said method, the shoe is located both lengthwise and heightwise as aforesaid by engagement under pressure of the backseam region of the upper and the heel seat region of the shoe respectively with a heel band and a holddown, whereafter the pressure between the backseam region of the upper and the heel band is relieved while the clamping engagement between the heel seat region of the shoe and the holddown is maintained. In this way, once located, the shoe is held in location by the holddown and not by the heel band. The side lasting operation can then take place while the backseam region of the upper is under no pressure, whereafter, with the side lasting instrumentalities still pressing the lasting marginal portions of the side portions of the upper, the heel band can be returned into pressing engagement with the backseam region of the shoe upper and the hole of the backpart of the shoe can be clamped thereby in readiness for the heel seat lasting operation.

In a preferred embodiment of the invention, furthermore, after the heel seat region of the shoe and the holddown are moved into clamping engagement, the backseam region of the upper and the heel band are separated from one another until after the side lasting instrumentalities have been caused to operate as aforesaid. By so separating the backseam region and the heel band, preferably through a short distance, e.g. up to 5 mm, it can be ensured that no pressure is applied by the heel band toewardly of the shoe during the side lasting operation.

In order to enhance the side lasting operation, and further to ensure that no excess material gathers just forwardly of the heel band, furthermore, conveniently after the clamping pressure between the backseam region of the upper and the heel band has been relieved and prior to operation of the side lasting instrumentalities, a drafting force is applied to the upper in the region of the heel breast line in a direction away from the topline of the shoe.

In one embodiment, furthermore, such drafting force is applied using pincers which grip the upper in the heel breast line region thereof.

In one method in accordance with the invention, the side portions of the shoe upper may be clamped against the last just prior to the inward movement of the side lasting instrumentalities over the shoe bottom. Such clamping may be effected by two sets of pad members movable inwardly towards one another to clamp the shoe disposed therebetween. As an alternative to the use of breast line grippers as aforementioned, furthermore, each set of pad members may also comprise an auxiliary member arranged to engage the shoe in the heel breast line region thereof, each auxiliary member being capable of moving heightwise of the last. Thus, in carrying out a method using such auxiliary members, as the set of pad members are moved inwardly as aforesaid, the auxiliary members engage the shoe upper and are moved heightwise of the last, a drafting force being thus applied by said members to the side portions of the shoe in the heel breast line region.

Whichever arrangement for providing the drafting force in the heel breast line region is used, after the force has been applied, in carrying out a method in accordance with the invention preferably the "legs" of the heel band are closed onto the shoe upper thus to clamp the upper against the last in the heel breast line region thereof, the remainder of the backpart of course remaining unclamped by the band. Such clamping of the upper in said region assists in maintaining the upper in position for the subsequent side lasting operation to be performed. Moreover, where the drafting force has been applied by grippers, said force can be relieved once the upper is clamped against the work as aforesaid in the heel breast line region. After the side lasting operation has been effected, the clamping pressure applied as aforesaid by the heel band is relieved and the heel band can then be utilized to clamp the whole of the backpart of the shoe in the manner described above, in readiness for the heel seat lasting operation.

In carrying out a method in accordance with the invention, conveniently, for securing the lasting marginal portions of the side portions of the upper to the corresponding marginal portions of the insole, adhesive is applied progressively, e.g. by nozzles, along the marginal portions of the insole prior to said side portions being clamped as aforesaid. Alternatively, adhesive may be applied, subsequent to the side portions having been clamped as aforesaid, progressively along the side portions in the angle formed by the insole and the lasting marginal portions of the upper using nozzles which are guided by said lasting marginal portions.

Furthermore, the invention is considered to be particularly advantageous where the lasting marginal portions of the upper, in the heel seat region thereof, are secured to the corresponding marginal portions of the insole by means of tacks.

The invention also comprises, in another of its several aspects, a shoe upper conforming machine for use in the lasting of heel seat and side portions of shoes, and more especially for use in carrying out a method as set out above, said machine comprising (i) a support for a shoe comprising an upper, the heel seat and side portions of which are to be lasted, on a last with an insole on the last bottom, (ii) a holddown which is disposed opposite the support and by which the heightwise position of the heel seat region of the shoe can be determined, (iii) two side lasting instrumentalities arranged so as to act on opposite side portions of the upper of a shoe supported by said support, (iv) heel seat lasting instrumentalities for lasting the heel seat region of such upper, the heel seat lasting instrumentalities comprising a heel seat wiper assembly and a generally U-shaped heel band, the latter serving to determine the lengthwise position of the shoe (v) first power means for effecting relative movement of approach between the heel seat lasting instrumentalities and the support whereby the backseam region of a shoe supported on the support can be pressed against the heel band, (vi) second power means for effecting relative movement of approach between said support and the holddown whereby the heel seat region of such shoe can be pressed against the holddown, and (vii) third power means for closing the "legs" of the heel band onto the backpart of such shoe, the arrangement being such that, in the operation of the machine, the first power means and the second power means are actuated whereby a shoe is clamped on the support with its heel seat portion disposed in a predetermined relationship with the heel seat wiper assembly in directions extending both lengthwise and widthwise of the shoe, whereafter the first power means is deactuated, thereafter the side lasting instrumentalities are operated, whereafter the first power means and then the third power means are actuated, and thereafter the heel seat wiper assembly are operated.

Conveniently, furthermore, in such machine means is provided whereby the heel band is movable between an operative position, in which it is in a predetermined relationship with the heel seat wiper assembly and serves to determine the lengthwise position of the shoe, and a retracted position, the arrangement being such that, in the operation of the machine, said means is effective to cause the heel band to be moved to its retracted position when the first power means is deactuated prior to operation of the side lasting instrumentalities, and to cause it to be returned to its operative position prior to actuation of the first and third power means prior to operation of the heel seat wiper assembly. Furthermore, preferably after the heel band has moved to its retracted position as aforesaid and prior to the operation of the side lasting instrumentalities, the third power means is actuated, said third power means then being deactuated prior to the return of the heel band to its operative position.

In addition, means may be provided, including two grippers arranged one at either side of the support, in the heel breast line region of a shoe supported thereby, for applying a drafting force to the upper of such shoe in said region in a direction away from the topline thereof, the arrangement being such that, in the operation of the machine, said means is caused to operate after the shoe has been clamped on the support as aforesaid and prior to operation of the side lasting instrumentalities, the third power means being actuated as aforesaid, after the drafting force has been applied.

DESCRIPTION OF THE DRAWINGS

There now follows a detailed description, to be read with reference to the accompanying drawings, of one method in accordance with the invention and one machine in accordance with the invention, hereinafter referred to respectively as the "illustrative method" and "illustrative machine". It will of course be appreciated that this illustrative method and this illustrative machine have been selected for description merely by way of exemplification of the invention and not by way of limitation thereof.

In the accompanying drawings.

DESCRIPTION OF THE PREFERRED EMBODIMENT

Figure 1:
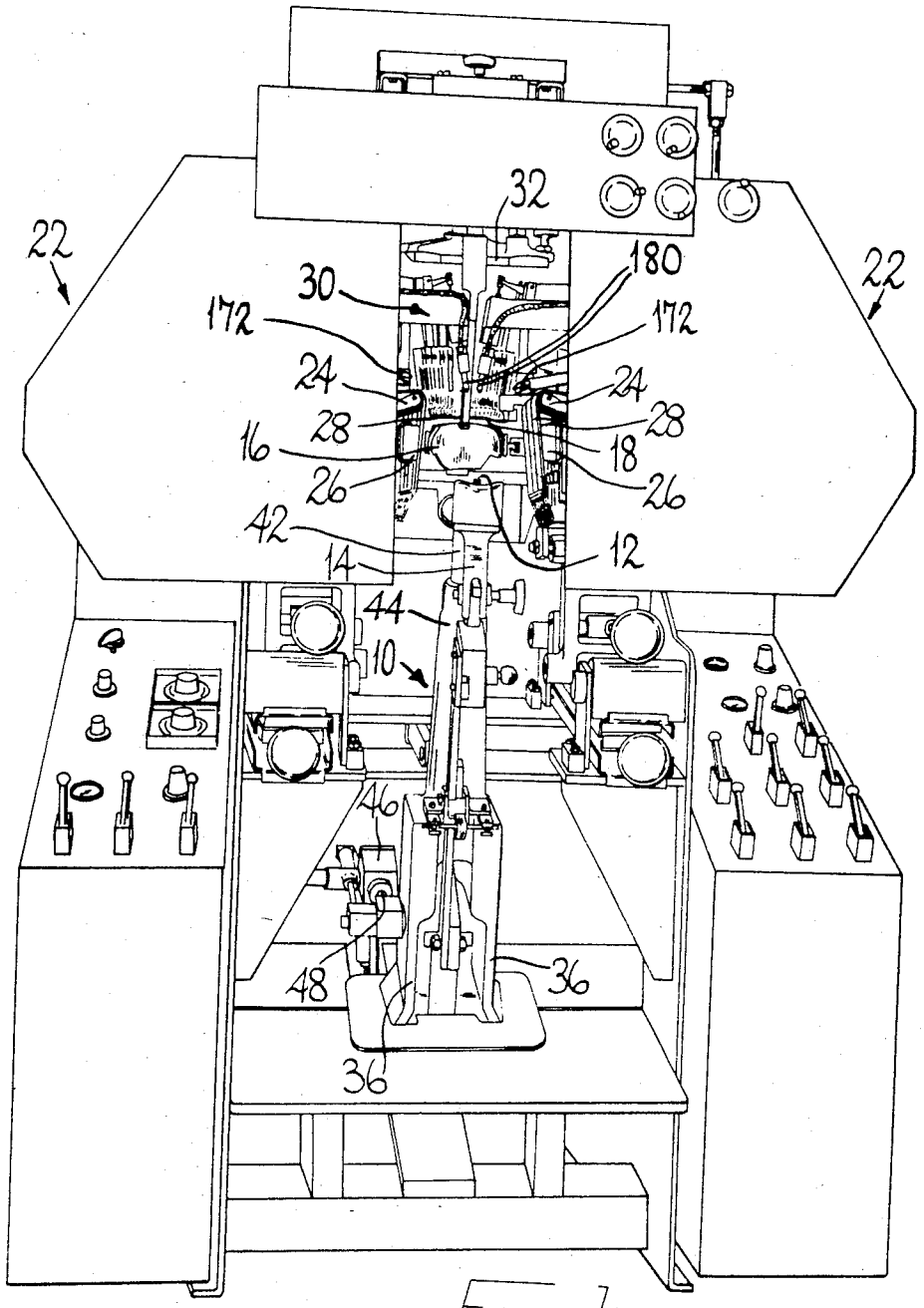
FIG. 1 is a front perspective view of the illustrative machine.

The illustrative machine, which is generally similar, except as hereinafter described, to the machine described in our U.S. patent application No. 412,846, filed Aug. 30, 1982, is a machine for use in the combined lasting of heel seat and side portions of shoes and comprises a shoe support generally designated 10, including a last pin 12 on which a shoe can be supported, bottom uppermost, and a toe rest 14, a heel band 16, a heel seat wiper assembly including two wiper plates 18 (the heel band wiper plates constituting heel seat lasting instrumentalities of the machine), a holddown generally designated 20 and side lasting instrumentalities generally designated 22, said instrumentalities comprising a plurality of fingers 24, a plurality of clamp pads 26 and lasting strap elements 28 extending over said fingers 24 and pads 26. The side lasting instrumentalities 22 are generally similar to those described in our U.S. patent application No. 316,980, filed Nov. 2, 1981. The heel seat lasting instrumentalities also comprises fastener-inserting means generally designated 30, including individual devices actuated by a pneumatically operated striker plate 32.

The shoe support 10 comprises a column 42, on which the last pin 12 and toe rest arrangement 14 are supported, the column 42 being mounted for sliding heightwise movement in a post 44 which is in turn mounted for pivotal movement, in a bracket 36, about a shaft (not shown) extending widthwise of the machine. For effecting pivotal movement of the shoe support 10 first power means, constituted by a piston-and-cylinder arrangement 46, is provided, a piston rod 48 of which is pivotally connected to the post 44. In the operation of the machine, a shoe is placed on the shoe support and the shoe support is then caused to swing in the bracket 36 to bring the backpart of the shoe into engagement with the heel band 16, thereby positioning the shoe, in a direction extending along its length, in a desired relationship with the heel seat lasting instrumentalities of the machine.

The illustrative machine also comprises second power means for moving the shoe support 10 heightwise to bring the heel seat region of the shoe supported thereby into engagement with the holddown 20, said second power means comprising a wedge member (not shown) movable along a horizontal path, on a base of the machine frame, by means of a piston-and-cylinder arrangement (not shown) supported by a bracket on said base, the wedge member being arranged to engage a foot (not shown) pivotally connected to the lower end of the column 42, said column extending through the post 44 and projecting downwardly from the under-side thereof. (The foot, wedge member and piston-and-cylinder arrangement referred to above are denoted by reference numerals 74, 76, 78 respectively in our U.S. application No. 412,846, filed Aug. 30, 1982). Operation of said piston-and-cylinder arrangement is thus effective, through the wedge member, to raise or lower the column 42, and thus the shoe support 10, together with the shoe supported thereby, towards and away from the holddown 20. The holddown 20 is positioned above the shoe support whereby to locate the heel seat region of a shoe supported by the shoe support in a predetermined relationship with the heel seat lasting instrumentalities, in a direction extending heightwise of the shoe.

The heel band 16 of the illustrative machine, and the actuating means therefor are generally similar to the heel band actuating means of the machine described in our U.S. patent application No. 170,690, filed July 21, 1980. Thus, the heel band is supported by an arrangement comprising a support plate 122 having bolted thereto a plate 124 having a cut-away portion forming a recess 126 for receiving a tab 128 forming part of a support bracket 130 to which the heel band is secured at the backseam region thereof. Adjacent the backseam region, furthermore, are two lugs 134, welded to the plate 124 and a further plate 132, against which lugs the heel band can abut to provide additional support adjacent the backseam region thereof. The heel band 16 is generally U-shaped and the "legs" of the band are supported, and also actuated, each by a presser plate 138 which receives a stud 136 of the band in an open-ended slot and further which is pivotally supported on a lever 144. The levers 144 are pivotally supported, on spacer shafts 142 between the plates 124, 132, each spacer shaft supporting a further lever 146 which carries a roll 152 engageable with an inclined face provided by a wedge member 154. The wedge members 154 are mounted for sliding movement, widthwise of the machine, on a rod 156 secured centrally in a a block 158 carried by the support plate 122, each wedge member 154 having a rearwardly extending lug 160. A cylinder 162 of a double-acting piston-and-cylinder arrangement is connected to one of said lugs 160 and a piston rod 164 of said arrangement to the other lug. For adjustment purposes, furthermore, each lever 146 carries an adjustable stop member 148 arranged to engage with the portion of its associated lever 144, a spring 150 being provided for urging the lever 144 against the stop member.

In the operation of the illustrative machine, actuation of the piston-and-cylinder arrangement 162, 164 (which constitutes third power means of the illustrative machine) causes the wedge members 154 to move towards one another and thus, through the rolls 152 and levers 146, to cause the levers 144 to pivot to urge the "legs" of the heel band 16 clampingly to engage the shoe.

In using the illustrative machine, it is from time to time desirable to vary the fore-and-aft position of the heel band 16 relative to the heel seat wiper assembly 18 and to this end, the support plate 122 is carried in slideways 100 provided on the main frame of the machine. For varying the position of the support plate 122 in the slideways, a threaded shaft 114 is provided, held captive in a block 118 secured to the under-side of the block 158. A forward end of the threaded shaft 114 carries a knob 102 by which the operator can thus rotate the shaft, and the rearward end of the shaft is threadedly received in a further block 116 which is carried on the main frame. Thus, rotation of the shaft 114 is effective to vary the position of the support plate 122, and thus of the heel band 16, fore-and-aft of the machine.

Figure 2:
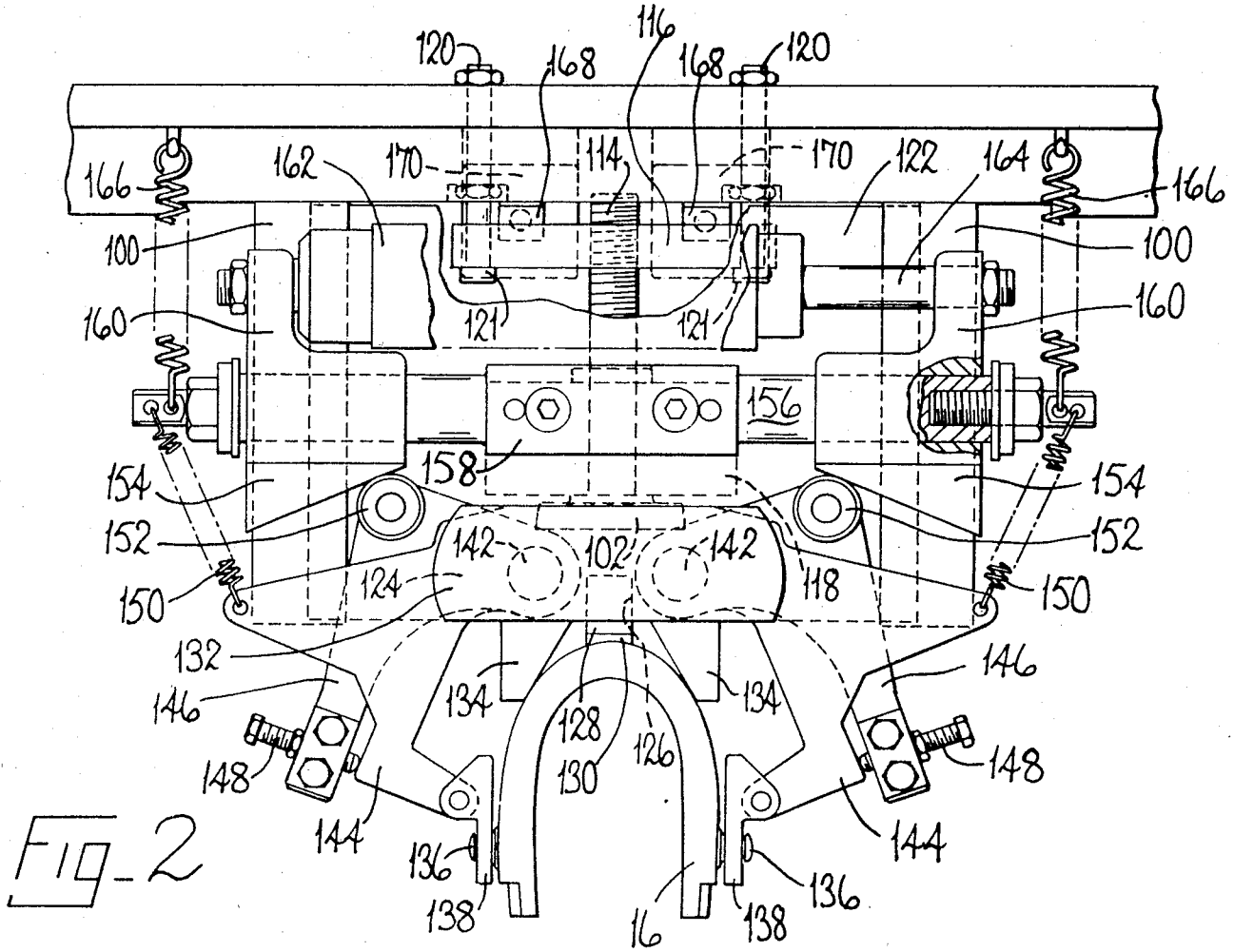
FIG. 2 is a fragmentary plan view of the illustrative machine, showing a heel band and actuating means therefor, together with means for effecting movement of the heel band between an operative and retracted position.

The heel band 16 of the illustrative machine is further mounted for movement between an operative position (as shown in FIG. 2) and a retracted position, for which purpose the support plate 122 is movable in the slideways 100 in a manner now to be described. The block 116 is carried on two shaft 120 projecting forwardly from the machine frame, the shaft being arranged one at either side of the shaft 114 and each shaft 120 having at its forward end a headed portion 121 against which a forward face of the block 116 can abut. The stop faces of the headed portions determine the operative position of the heel band 16. Acting between the plate 122 and the main frame of the machine are two springs 166 which are effective to urge the support plate 122, and the heel band 16 therewith, rearwardly out of said operative position to a retracted position. For moving the heel band to its operative position out of such retracted position, two wedge members 168 are provided arranged to act between a rearward face of the block 116 and a forward face of the part of the machine frame supporting the shafts 120, the wedge members 168 being movable heightwise under the action of pneumatic piston-and-cylinder arrangements 170. Thus, in the operation of the illustrative machine, when it is required that the heel band be located in its operative position, the piston-and-cylinder arrangements 170 are actuated and force the block 116, and thus the heel band 16 therewith, forwardly. For moving the heel band 16 to its retracted position, on the other hand, the piston-and-cylinder arrangement 170 are actuated to withdraw the wedge members 168, whereupon the springs 166 operate to retract the support plate 122, and thus the heel band.

The illustrative machine further comprises means for applying an updrafting force to the shoe upper in the heel breast line region thereof, said means comprising two grippers 172, arranged one at either side of the shoe support 10 adjacent the rearward end of the side lasting instrumentalities 22. Each gripper 172 is movable, by means of a piston-and-cylinder arrangement (not shown) between an advanced position, in which the gripper can engage and grip the upstanding lasting marginal portion of a shoe upper on the shoe support, in the heel breast line region thereof, and an out-of-the-way position, the arrangement being such that, in the operation of the machine, the grippers move to their advanced positions, grip said lasting marginal portions and are retracted, thus to apply the updrafting force to the upper in said region. Subsequently, the grippers 172 release the upper, whereupon they are returned to their out-of-the-way positions.

Figure 3A:
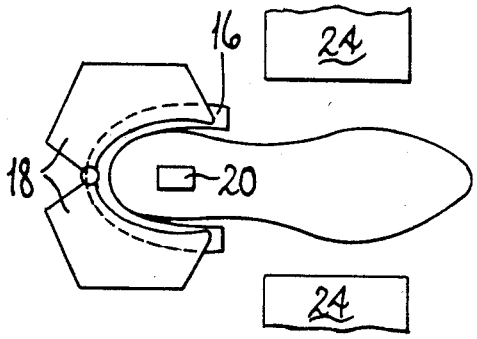
FIGS. 3*a* to 3*d* are diagrammatic representations indicating a sequence of operations in carrying out the illustrative method.

In the operation of the illustrative machine, in carrying out the illustrative method, the operator places a shoe, comprising a shoe upper on a last with an insole on the last bottom, on the shoe support 10, locating the toe rest 14 appropriately according to whether the shoe is a left or a right, in conventional manner, and thereafter initiates a cycle of operation of the machine, in which firstly, by the operation of the piston-and-cylinder arrangement 46 the shoe support is swung rearwardly to carry the backpart of the shoe into the heel band 16, and also the piston-and-cylinder arrangement (not shown) operating the wedge member for the shoe support is operated to raise the shoe support to bring the heel seat region of the shoe supported thereon into engagement with the holddown 20 (as fully described in our U.S. patent application No. 412,846, filed Aug. 30, 1982), whereby the shoe is located both lengthwise and heightwise in relation to the heel seat wiper assembly 18 of the illustrative machine (FIG. 3*a*).

With the shoe clampingly urged by the wedge member (not shown) against the holddown 20, the piston-and-cylinder arrangement 46 is deactuated and at the same time the wedge members 168, acting between the block 116 and the main frame for maintaining the heel band 16 in its operative position, are retracted by the piston-and-cylinder arrangement 170. Thus, the pressure applied by the heel band in and adjacent the backseam region of the shoe upper is relieved and further the backseam region of the upper and the heel band are separated from one another so that, during the subsequent side lasting operation the backpart of the upper is free of any clamping pressure at least in and adjacent the backseam region thereof.

Figure 3B:
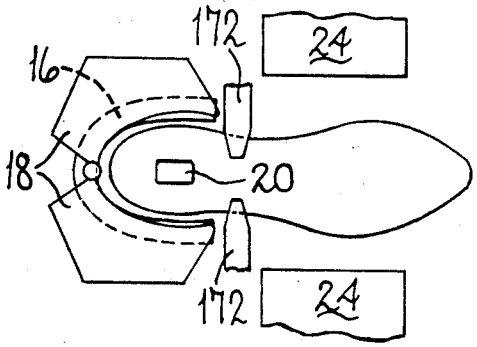

With the shoe thus supported, the breast line grippers 172 are then moved to their advanced position and caused to grip the upstanding lasting margin of the shoe upper in the heel breast line thereof (see FIG. 3*b*). The breast line grippers 172 are then caused to move towards their out-of-the-way position, whereby an updrafting force is applied thereto in said region. Thereafter, while said updrafting force is applied, the "legs" of the heel band 16 are caused to close on to the shoe upper, by the action of piston-and-cylinder arrangement 162, 164, thus to clamp the upper against the last in the heel breast line region, so that the upper material displaced by the action of the breast line grippers 172 can be maintained in the position to which it has been thus displaced. Thereafter, the breast line grippers 172 can be caused to release their grip on the lasting marginal portions of the upper and retract to their out-of-the-way position, and then cement is applied progressively along the opposite marginal portions of the insole by means of nozzles 180 (FIG. 1), as more fully described in our U.S. patent application No. 135,978, filed May 31, 1980.

Figure 3C:
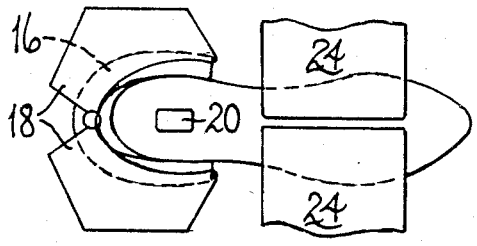

With the cement applied, the side lasting instrumentalities 22 are moved inwardly firstly to clamp the side portions of the shoe upper against the last, and thereafter to cause the lasting marginal portions of the side portions to be wiped over and pressed against corresponding marginal portions of the insole, previously applied adhesive serving to cause said marginal portions to be bonded together. The side lasting instrumentalities then dwell in pressing engagement with the shoe bottom to enable the bond to be consolidated (see FIG. 3*c*).

Figure 3D:
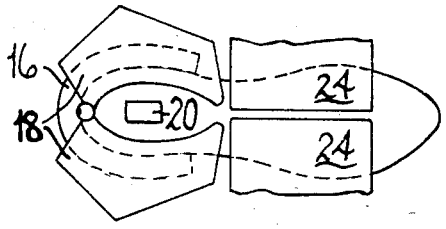

During this dwell time, and while the side lasting instrumentalities are thus in pressing engagement with the shoe bottom the clamping forces on the "legs" of the heel band are released, thus unclamping the shoe in the heel breast line region thereof, and, by actuation of the piston-and-cylinder arrangements 170, the band is returned to its advanced position, whereafter the piston-and-cylinder arrangement 46 is again actuated to urge the backseam of the shoe against the heel band, the piston-and-cylinder arrangements 162, 164 then again being actuated to cause the backpart of the upper to be clamped over substantially the whole of its surface by the heel band. With the backpart now thus clamped, the heel seat wiper assembly 18 is caused to move inwardly from a retracted position and lasting marginal portions of the heel seat portion of the upper are thus wiped over and pressed against corresponding marginal portions of the insole, tacks then being inserted by the fastener-inserting means to secure the over-wiped lasting marginal portions to the corresponding marginal portions of the insole (see FIG. 3*d*).

The shoe upper is thus lasted from the joint region to the heel end by the side lasting and heel seat lasting instrumentalities, which together provide a continuous wiping surface over the whole region to be lasted. Furthermore, because, during the side lasting operation, the heel band is not exerting any toeward force on the upper, the side lasting operation can be effected without excess material being present in the heel breast line region, whereafter the heel seat lasting operation can take place, such operation itself taking up any excess material which may be found in the heel seat region.

We claim:

1. A method of lasting heel seat and side portions of a shoe comprising the steps of:

(i) placing a shoe, comprising a shoe upper on a last with an insole on the last bottom, on a support and locating it both lengthwise and heightwise in a predetermined relationship with a heel seat wiper assembly by engagement under pressure of the backseam region of the upper and the heel seat region of the shoe respectively with a heel band and a holddown;

(ii) relieving the pressure between the backseam region of the upper and the heel band while maintaining clamping engagement between the heel seat region of the shoe and the holddown;

(iii) causing side lasting instrumentalities to move inwardly over the shoe bottom whereby lasting marginal portions of said side portions are wiped over and pressed against corresponding marginal portions of the insole;

(iv) with the side lasting instrumentalities thus pressing said lasting marginal portions of the upper, returning the heel band the backseam region of the shoe upper into pressing engagement and clamping the backpart of the shoe by means of the heel band; and (v) with the backpart thus clamped, causing the heel seat wiper assembly to move inwardly over the last bottom whereby lasting marginal portions of the heel seat portion of the upper are wiped over and pressed against corresponding marginal portions of the insole.

2. A method according to claim 1 wherein after the heel seat region of the shoe and the holddown are moved into clamping engagement, the backseam region of the upper and the heel band are separated from one another until after the side lasting instrumentalities have been caused to operate as aforesaid.

3. A method according to claim 2 wherein after the clamping pressure between the backseam region of the upper and the heel band has been relieved and prior to operation of the side lasting instrumentalities, a drafting force is applied to the upper in the region of the heel breast line in a direction away from the topline of the shoe.

4. A method according to claim 3 wherein the drafting force is applied using pincers which grip the upper in the heel breast line region.

5. A method of lasting heel seat and side portions of a shoe comprising the steps of:

(i) supporting a shoe, comprising a shoe upper carried on a last and an insole on the last bottom, with the heel seat portion disposed in a predetermined relationship with a heel seat wiper assembly in directions extending both heightwise and lengthwise of the shoe, but with said assembly in a retracted position;

(ii) with the shoe thus supported, applying a drafting force to the upper in the region of the heel breast line in a direction away from the topline of the shoe, and clamping side portions of the shoe upper against the last, while the backpart of the upper remains unclamped at least in and adjacent the backseam region thereof;

(iii) with the shoe upper clamped as aforesaid, causing side lasting instrumentalities to move inwardly over the shoe bottom whereby lasting marginal portions of said side portions are wiped over and pressed against corresponding marginal portions of the insole; and (iv) with the side lasting instrumentalities thus pressing said lasting marginal portions of the upper, clamping the backpart of the upper against the last over substantially the whole of its surface and causing the heel seat wiper assembly to move inwardly from its retracted position whereby lasting marginal portions of the heel seat portion of the upper are wiped over and pressed against corresponding marginal portions of the insole.

6. A method according to claim 5 wherein the shoe is located with its heel seat portion disposed as aforesaid by engagement of the backseam region of its upper with a heel band, by which the backpart of the upper is subsequently clamped as aforesaid over substantially the whole of its surface.

7. A method according to either one of claims 6 or 5 wherein the side portions of the shoe upper are clamped as aforesaid by two sets of pad members movable inwardly towards one another to clamp the shoe disposed therebetween, each set also comprising an auxiliary member arranged to engage the shoe in the heel breast line region thereof, and each auxiliary member being capable of movement heightwise of the last, and wherein, as the sets are moved inwardly as aforesaid, the auxiliary members engage the shoe upper and are moved heightwise of the last and a drafting force is thus applied by said members to the side portions of the shoe in the heel breast line region.

8. A method of lasting heel seat and side portions of a shoe comprising the steps of:

(i) supporting a shoe, comprising a shoe upper carried on a last and an insole on the last bottom, on a support therefor and locating the shoe (a) lengthwise, by engagement of the backseam region thereof with a generally U-shaped heel band under a first applied force, and (b) heightwise, by engagement of the heel seat region thereof with a holddown under a second applied force, whereby the heel seat portion is disposed in a predetermined relationship with a heel seat wiper assembly in directions extending both heightwise and lengthwise of the shoe, but with said assembly in a retracted position;

(ii) thereafter releasing said first applied force, but retaining the heel seat portion in said predetermined relationship by means of the second applied force;

(iii) with the shoe thus supported, applying a drafting force to the upper in the region of the heel breast line in a direction away from the topline of the shoe;

(iv) while said drafting force is applied, closing the "legs" of the heel band on to the shoe upper thus to clamp the upper against the last in the heel breast line region thereof, while the remainder of the backpart remains unclamped thereby;

(v) thereafter clamping side portions of the shoe against the last;

(vi) with the shoe upper clamped as aforesaid, causing side lasting instrumentalities to move inwardly over the shoe bottom whereby lasting marginal portions of said side portions are wiped over and pressed against corresponding marginal portions of the insole;

(vii) with the side lasting instrumentalities thus pressing said lasting marginal portions of the upper, releasing the clamping pressure applied by the heel band, re-applying said first applied force and, while said force is applied, re-applying said clamping pressure, whereby the backpart of the shoe is clamped against the last over substantially the whole of its surface; and (viii) thereafter causing the heel seat wiper assembly to move inwardly from its retracted position whereby lasting marginal portions of the heel seat portion of the upper are wiped over and pressed against corresponding marginal portions of the insole.

9. A method according to claim 8 wherein, after the first applied force is released and before the "legs" of the heel band are closed as aforesaid, the heel band is moved out of engagement with the backseam region of the shoe.

10. A method according to claim 9, wherein the drafting force is applied to the side portions of the upper using pincers which grip the upper in the heel breast line region.

11. A method according to claim 9 wherein, for securing the lasting marginal portions of the side portions of the upper to the corresponding marginal portions of the insole, adhesive is applied progressively along the marginal portions of the insole prior to said side portions being clamped as aforesaid.

12. A method according to claim 9 wherein, for securing the lasting marginal portions of the side portions of the upper to the corresponding marginal portions of the insole, adhesive is applied, subsequent to the side portions having been clamped as aforesaid, progressively along the side portions in the angle formed by the insole and the lasting marginal portions of the upper using nozzles guided by said lasting marginal portions.

13. A method according to claim 9 wherein the lasting marginal portions of the upper, in the heel seat region thereof, are secured to the corresponding marginal portions of the insole by means of tacks.

14. A shoe upper conforming machine for use in the lasting of heel seat and side portions of shoes comprising:

(i) a support for a shoe comprising an upper, the heel seat and side portions of which are to be lasted, on a last with an insole on the last bottom;

(ii) a holddown which is disposed opposite the support and by which the heightwise position of the heel seat region of the shoe can be determined;

(iii) two side lasting instrumentalities arranged so as to act on opposite side portions of the upper of a shoe supported by said support;

(iv) heel seat lasting instrumentalities for lasting the heel seat region of such upper, the heel seat lasting instrumentalities comprising a heel seat wiper assembly and a generally U-shaped heel band, the latter serving to determine the lengthwise position of the shoe;

(v) first power means for effecting relative movement of approach between the heel seat lasting instrumentalities and the support whereby the backseam region of a shoe supported on the support can be pressed against the heel band;

(vi) second power means for effecting relative movement of approach between said support and the holddown whereby the heel seat region of such shoe can be pressed against the holddown; and (vii) third power means for closing the "legs" of the heel band on to the backpart of such shoe, the arrangement being such that, in the operation of the machine, the first power means and the second power means are actuated whereby a shoe is clamped on the support with its heel seat portion disposed in a predetermined relationship with the heel seat wiper assembly in directions extending both lengthwise and widthwise of the shoe, whereafter the first power means is deactuated, thereafter the side lasting instrumentalities are operated, whereafter the first power means and then the third power means are actuated, and thereafter the heel seat wiper assembly is operated.

15. A machine according to claim 14 wherein means is provided whereby the heel band is movable between an operative position, in which it is in a predetermined relationship with the heel seat wiper assembly and serves to determine the lengthwise position of the shoe, and a retracted position, the arrangement being such that, in the operation of the machine, said means is effective to cause the heel band to be moved to its retracted position when the first power means is deactuated prior to operation of the side lasting instrumentalities, and to cause it to be returned to its operative position prior to actuation of the first and third power means prior to operation of the heel seat wiper assembly.

16. A machine according to claim 15 wherein, after the heel band has moved to its retracted position as aforesaid and prior to the operation of the side lasting instrumentalities, the third power means is actuated, said third power means then being deactuated prior to the return of the heel band to its operative position.

17. A machine according to either claim 15 or 16 wherein means is provided, including two grippers arranged one at either side of the support, in the heel breast line region of the shoe supported thereby, for applying a drafting force to the upper of such shoe in said region in a direction away from the topline thereof, the arrangement being such that, in the operation of the machine, said means is caused to operate after the shoe has been clamped on the support as aforesaid and prior to operation of the side lasting instrumentalities.

18. A machine according to claim 16 wherein means is provided, including two grippers arranged one at either side of the support, in the heel breast line region of a shoe supported thereby, for applying a drafting force to the upper of such shoe in said region in a direction away from the topline thereof, the arrangement being such that, in the operation of the machine, said means is caused to operate after the shoe has been clamped on the support as aforesaid and the third power means is actuated after the drafting force has been applied.

19. A machine according to claim 18 wherein the heel seat lasting instrumentalities also comprise fastener-inserting means by which fasteners can be inserted into the wiped-over lasting marginal portions of the upper and corresponding marginal portions of the insole, when pressed together as aforesaid, to secure them together.

* * * * *